US008348238B2

(12) United States Patent
Anderson et al.

(10) Patent No.: US 8,348,238 B2
(45) Date of Patent: Jan. 8, 2013

(54) MOVING DEVICE

(75) Inventors: Gary W. Anderson, Puyallup, WA (US); Kevin L. Salt, Mount Vernon, WA (US)

(73) Assignee: The Boeing Company, Chicago, IL (US)

( * ) Notice: Subject to any disclaimer, the term of this patent is extended or adjusted under 35 U.S.C. 154(b) by 934 days.

(21) Appl. No.: 12/109,097

(22) Filed: Apr. 24, 2008

(65) Prior Publication Data

US 2009/0267036 A1 Oct. 29, 2009

(51) Int. Cl.
*B66F 3/36* (2006.01)

(52) U.S. Cl. ..... 254/100; 254/98; 269/17; 269/21

(58) Field of Classification Search ..... 254/98, 254/100; 269/17, 21
See application file for complete search history.

(56) References Cited

U.S. PATENT DOCUMENTS

| | | | | |
|---|---|---|---|---|
| 4,183,511 | A * | 1/1980 | Marek | 269/17 |
| 5,655,734 | A * | 8/1997 | Dahl | 244/137.1 |
| 5,975,826 | A | 11/1999 | Scholder | |
| 6,540,242 | B1 | 4/2003 | Raichlen | |
| 6,543,117 | B1 * | 4/2003 | Claycomb et al. | 29/426.4 |
| 7,039,995 | B2 * | 5/2006 | Thompson | 29/281.5 |
| 7,438,301 | B2 * | 10/2008 | Schilling et al. | 280/79.7 |
| 7,610,666 | B2 * | 11/2009 | Adas et al. | 29/468 |

* cited by examiner

*Primary Examiner* — Lee D Wilson
*Assistant Examiner* — Shantese McDonald
(74) *Attorney, Agent, or Firm* — Klintworth & Rozenblat IP LLC

(57) ABSTRACT

A support unit for moving an object may include an elongated member, at least one suction device coupled to the elongated member for attaching to an object, a lifting mechanism for raising and lowering the elongated member and an attached object, and a rotating member for moving the support unit and the attached object from a departure location to a destination location.

35 Claims, 6 Drawing Sheets

MOVING DEVICE

BACKGROUND

Heavy objects, such as aircraft monuments comprising galleys, lavatories or other types of objects, often need to be moved from one location to another location. Some of the prior art systems and/or methods for moving heavy objects utilize carts, dollies, modified hand trucks, and/or hand-carried using suction cups. However, this may be difficult, costly, timely, inefficient, experience ergonomic issues, and/or have one or more other types of problems.

A device and/or method is needed to decrease one or more problems associated with one or more of the existing devices and/or methods for moving objects.

SUMMARY

In one aspect of the disclosure, a support unit for moving an object is provided. The support unit includes: an elongated member having an upper end and a lower end; at least one suction device attached to the elongated member between the upper end and the lower end for attaching to an object; a lifting mechanism attached to the elongated member for raising and lowering the elongated member, the at least one suction device, and an object attached to the at least one suction device; and a rotating member for moving the elongated member, the at least one suction device, and the object attached to the at least one suction device.

In another aspect of the disclosure, a method is provided of moving an object. In one step, at least one support unit is provided comprising an elongated member, at least one suction device attached to the elongated member, a lifting mechanism, and a rotating member. In another step, the at least one suction device is attached to the object at a departure location. In an additional step, the lifting mechanism is raised at the departure location to lift the object attached to the at least one suction device. In still another step, the lifted object attached to the at least one suction device is moved from the departure location to a destination location. In another step, the lifting mechanism is lowered at the destination location to lower the object attached to the at least one suction device.

In still another aspect of the disclosure, a system for moving an object includes a plurality of support units. Each support unit comprises: an elongated member having an upper end and a lower end; at least one attachment device for attaching to an object, wherein the at least one attachment device is attached to the elongated member between the upper end and the lower end; a rotating member for moving the elongated member, the at least one attachment device, and a raised object attached to the at least one attachment device; and a lifting mechanism attached between the elongated member and the rotating member for raising and lowering the elongated member, the at least one attachment device, and a raised object attached to the at least one attachment device.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
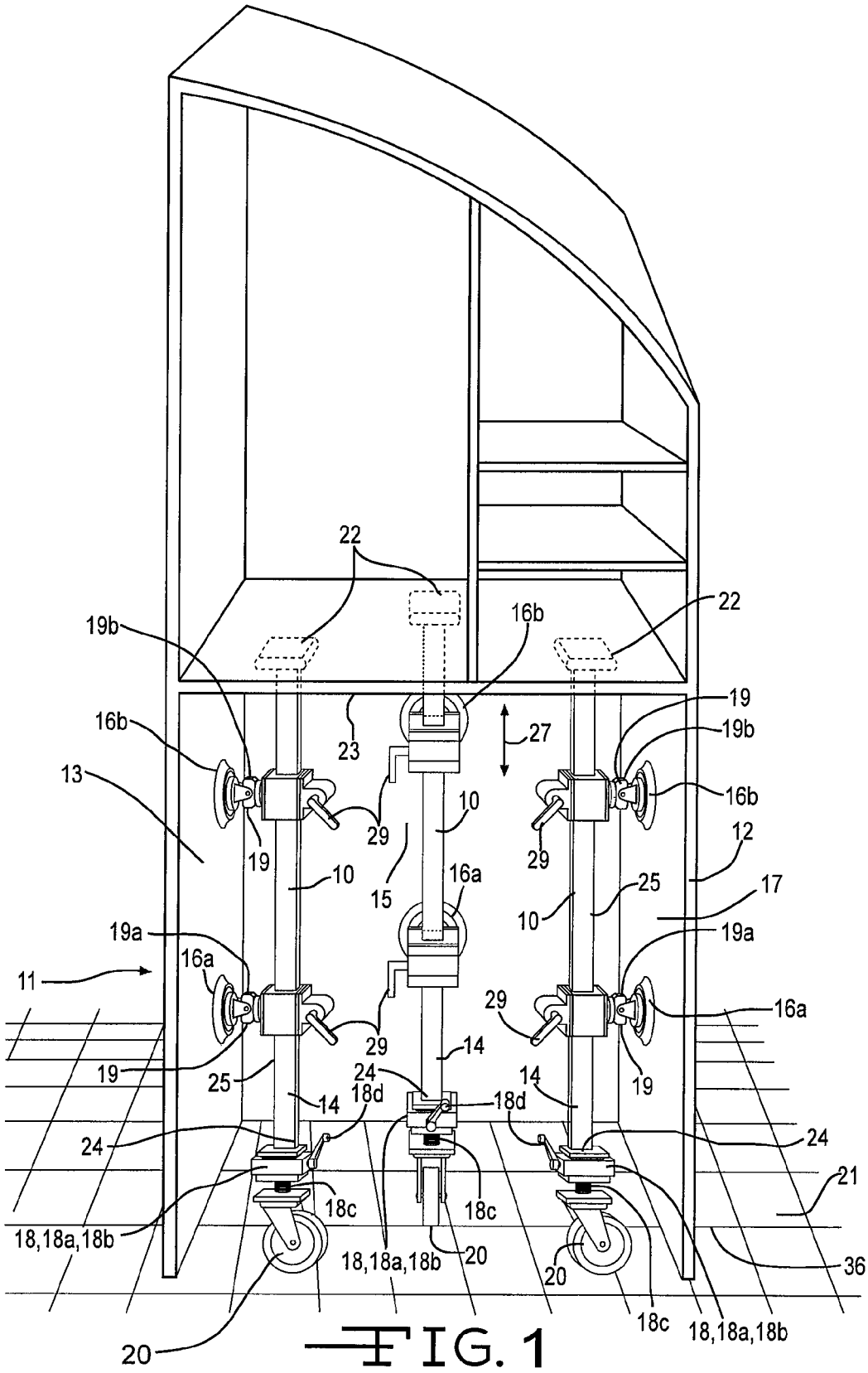
FIG. 1 shows a perspective view of a system attached to an object at a departure location, wherein the system may be used to move the object.

FIG. 1 shows a perspective view of a system 11 for moving an object 12. The system 11 may comprise a plurality of support units 10. Each of the support units 10 may be attached to separate sides 13, 15, and 17 of the object 12. In other embodiments, any number of support units 10 may be aligned in varying orientations and/or configurations relative to varying non-side surfaces of an object 12 in order to move the object 12. The support units 10 may be used to move an object 12 comprising at least one of an aircraft monument, an aircraft part, an airplane galley, and an airplane lavatory. In other embodiments, any number, type, size, configuration, and/or orientation of support units 10 may be used to move varying types of airplane and/or non-airplane objects. For instance, one, two, three, four, or more support units 10 may be used to move an object 12 comprising an aircraft monument, an aircraft part, an airplane galley, an airplane lavatory, or other type of object.

Each support unit 10 may include an elongated member 14, a plurality of suction devices 16*a* and 16*b*, a lifting mechanism 18, and a rotating member 20. It is preferable that two or more suction devices 16*a* and 16*b* be utilized. However, in other embodiments, one or more of the support units 10 may include any number, size, type, and/or configuration of elongated members 14, suction devices 16*a* and 16*b*, lifting mechanisms 18, and/or rotating members 20.

Each elongated member 14 may include an upper end 22 and a lower end 24. The upper end 22 of the elongated member 14 may be adapted to be disposed against a surface 23 of the object 12 in order to help support the object 12. The suction devices 16*a* and 16*b* may be coupled through swivel devices 19*a* and 19*b* to one side 25 of the elongated member 14 between the upper end 22 and the lower end 24. The swivel devices 19*a* and 19*b* may allow the suction devices 16*a* and 16*b* to swivel relative to the elongated member 14 to properly orient the suction devices 16*a* and 16*b* against the object 12.

The suction devices 16*a* and 16*b* may be slide-ably connected to the elongated member 14 to allow the suction devices 16*a* and 16*b* to be moved relative to and along the elongated member 14. Each suction device 16*a* and 16*b* may be adapted to be locked and unlocked from their positions against the elongated member 14 using one or more locking devices 29. In such manner, the position of the suction devices 16*a* and 16*b* may be changed relative to the elongated member 14 in order to align the suction devices 16*a* and 16*b* with the appropriate surface(s) of the object 12. The suction devices 16*a* and 16*b* of each support unit 10 may be adapted to be attached to various sides 13, 15, and 17 of the object 12 using vacuum suction. In other embodiments, varying non-suction types of attachment devices may be utilized in order to attach the support units 10 to varying surfaces of the object 12. Each suction device 16*a* and 16*b* may be attached to a level device 19 for leveling the object 12.

Each lifting mechanism 18 may be attached between the lower end 24 of the elongated member 14 and the rotating member 20. The lifting mechanism 18 may be adapted to raise and lower the elongated member 14 and/or an object 12 attached to the suction devices 16*a* and 16*b*. The lifting mechanism 18 may comprise a jacking member 18*a* comprising one or more of a gear drive 18*b*, a jack screw 18*c*, a crank 18*d*, and/or another type of lifting mechanism as known in the art for raising and lowering the elongated member 14. The lifting mechanism 18 may be adapted to jack up and/or jack down the attached elongated member 14 along direction 27 by a user applying manual labor to the lifting mechanism 18 without using a battery, electricity, and/or another power source. For instance, a user may manually rotate the crank 18*d* in order to lift and/or lower the elongated member 14 along direction 27 relative to the jack screw 18*c* using the gear drive 18*b*. In such manner, by rotating the crank 18*d*, the position of the elongated member 14, the attached suction devices 16*a* and 16*b*, and the object 12 attached to the suction devices 16*a* and 16*b* may be raised or lowered. The rotating member 20 may comprise one or more wheels attached to the lifting mechanism 18 near and/or at the lower end 24 of the elongated member 14. The rotating member 20 may be adapted to rotate to move the support unit 10 and a raised object 12 attached to the suction devices 16*a* and 16*b* from one position to another position in order to change the location of the object 12 relative to a surface 21 such as the ground or another type of surface.

Figure 2:
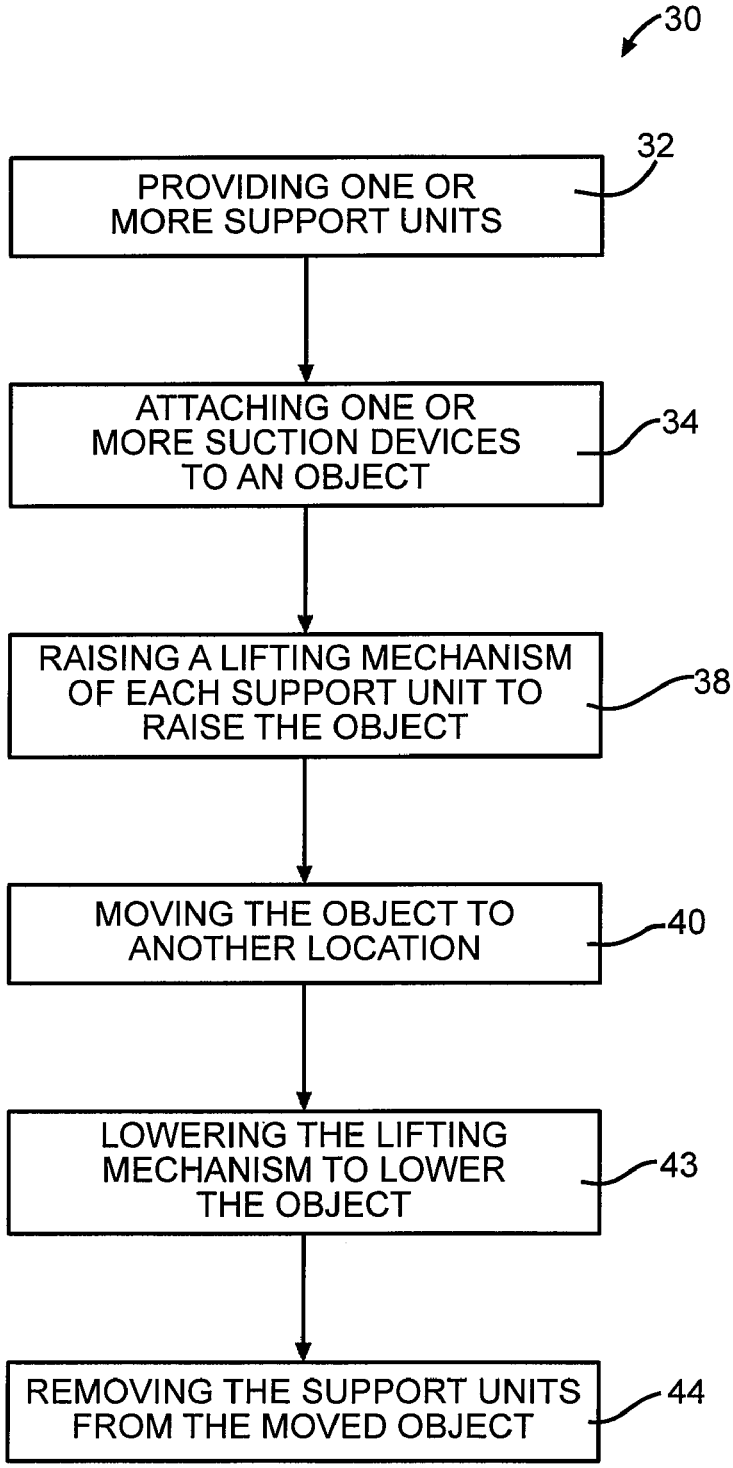
FIG. 2 shows a flowchart of one embodiment of a method for moving an object from a departure location to a destination location.

FIG. 2 shows a flowchart of one embodiment of a method 30 for moving an object 12. The object 12 moved under the method 30 may comprise an aircraft monument, an aircraft part, an airplane galley, an airplane lavatory, another type of airplane object, and/or a non-airplane object. In one step 32, one or more support units 10 may be provided. In one embodiment, as shown in FIG. 1, a plurality of support units 10 may be provided. In other embodiments, any number of support units 10 may be provided and used to move the object 12. For instance, one, two, three, four, five, or any number of support units 10 may be used to move the object 12.

Each support unit 10 may include: an elongated member 14 having an upper end 22 and a lower end 24; at least one suction device 16*a* and/or 16*b* coupled through swivels 19*a* and 19*b* to one side 17 of the elongated member 14 between the upper end 22 and the lower end 24; a lifting mechanism 18 coupled to the elongated member 14 comprising a jacking member 18*a* including one or more of a gear drive 18*b*, a jack screw 18*c*, a crank 18*d*, and/or another type of lifting mechanism; and at least one rotating member 20 comprising one or more wheels. The lifting mechanism 18 may be attached between the elongated member 14 and the rotating member 20. In other embodiments, each support unit 10 may comprise any of the embodiments disclosed herein. In still other embodiments, each support unit 10 may include any number, size, type, and/or configuration of elongated members 14, suction devices 16*a* and 16*b*, lifting mechanisms 18, and/or rotating members 20.

In another step 34 of the method of FIG. 2, the at least one suction device 16*a* and/or 16*b* of each support unit 10 may be attached to the object 12 at a departure location 36 along the surface 21 as shown in FIG. 1. The suction devices 16*a* and 16*b* of each respective support unit 10 may be attached to various sides 13, 15, and 17 of the object 12. During step 34, the lifting mechanisms 18 of each support unit 10 may be lowered and the suction devices 16*a* and 16*b* of each support unit 10 may be attached to the sides 13, 15, and 17 of the object 12 using vacuum suction pressure. Step 34 may further comprise sliding the at least one suction device 16*a* and/or 16*b* relative to the elongated member 14 and locking the at least one suction device 16*a* and/or 16*b* in place relative to the elongated member 14 using one or more locking devices 17. Step 34 may additionally comprise swiveling the at least one suction device 16*a* and/or 16*b* relative to the elongated member 14 using at least one swivel device 19*a* and/or 19*b*.

Figure 3:
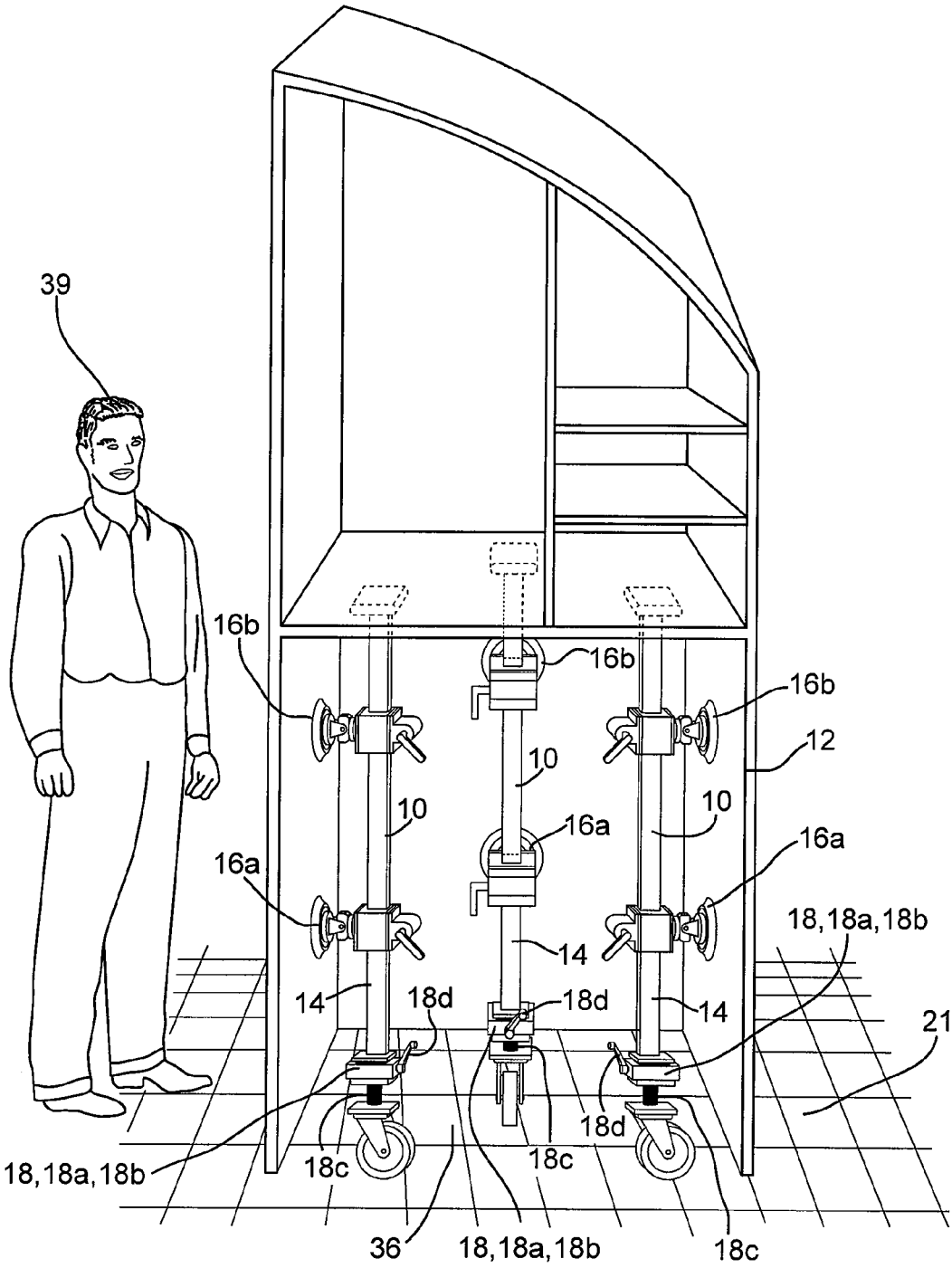
FIG. 3 shows a perspective view of the system of FIG. 1 having been raised at the departure location to raise the attached object.

In an additional step 38 of the method of FIG. 2, the lifting mechanism 18 of each support unit 10 may be raised at the departure location 36 to lift the object 12 attached to the at least one suction device 16 and/or 16*b* off the surface 21 as shown in FIG. 3. Step 38 may comprise a user 39 manually rotating the crank 18*d* to lift the elongated member 14 relative to the jack screw 18*c* using the gear drive 18*b*.

Figure 4:
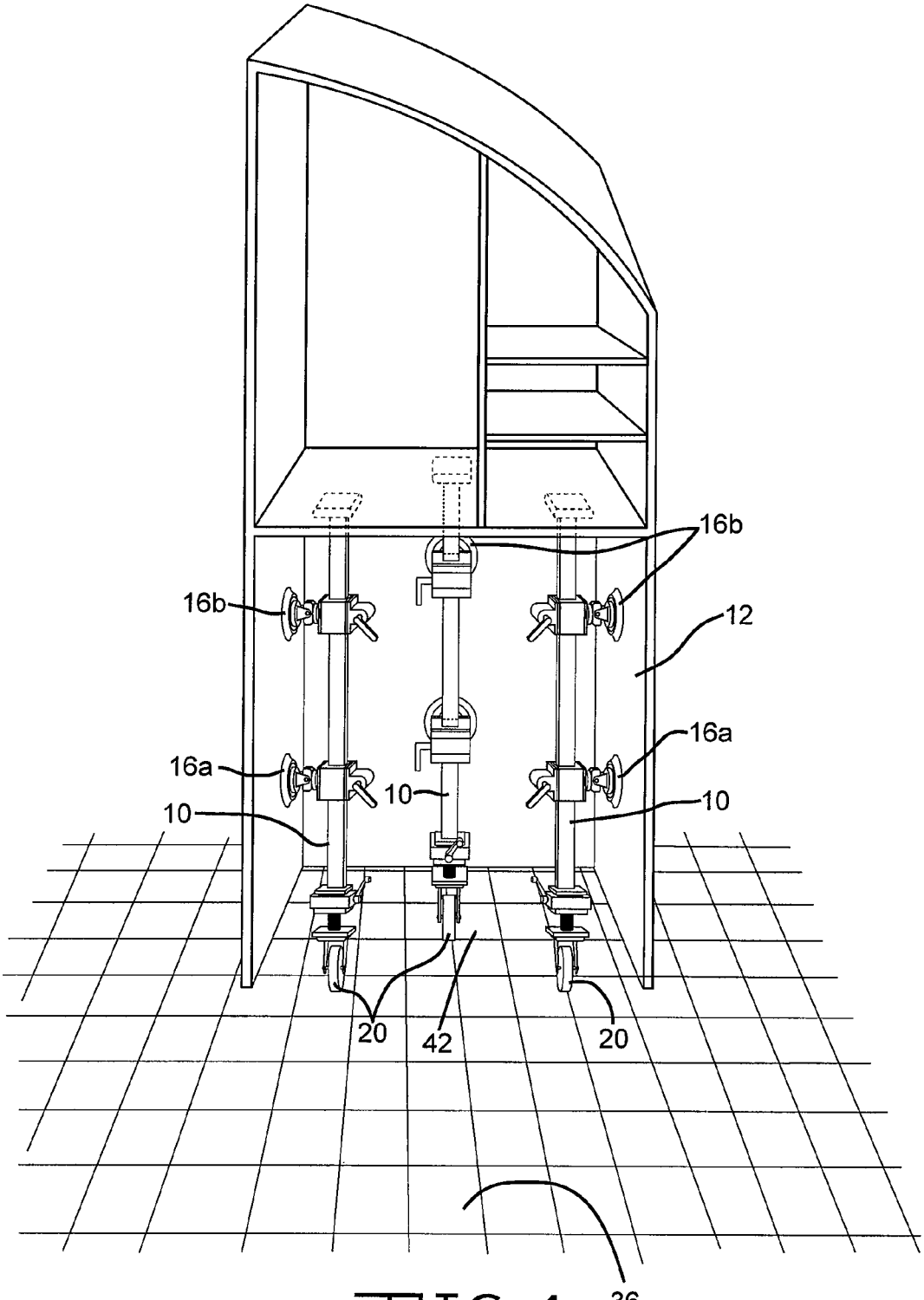
FIG. 4 shows a perspective view of the raised system and attached object of FIG. 3 having been moved from the departure location to the destination location.

In still another step 40 of the method of FIG. 2, the lifted object 12 attached to the at least one suction device 16*a* and/or 16*b* of each support unit 10 may be moved from the departure location 36 to a destination location 42 by rotating the rotating member 20 of each support unit 10 as shown in FIG. 4.

Figure 5:
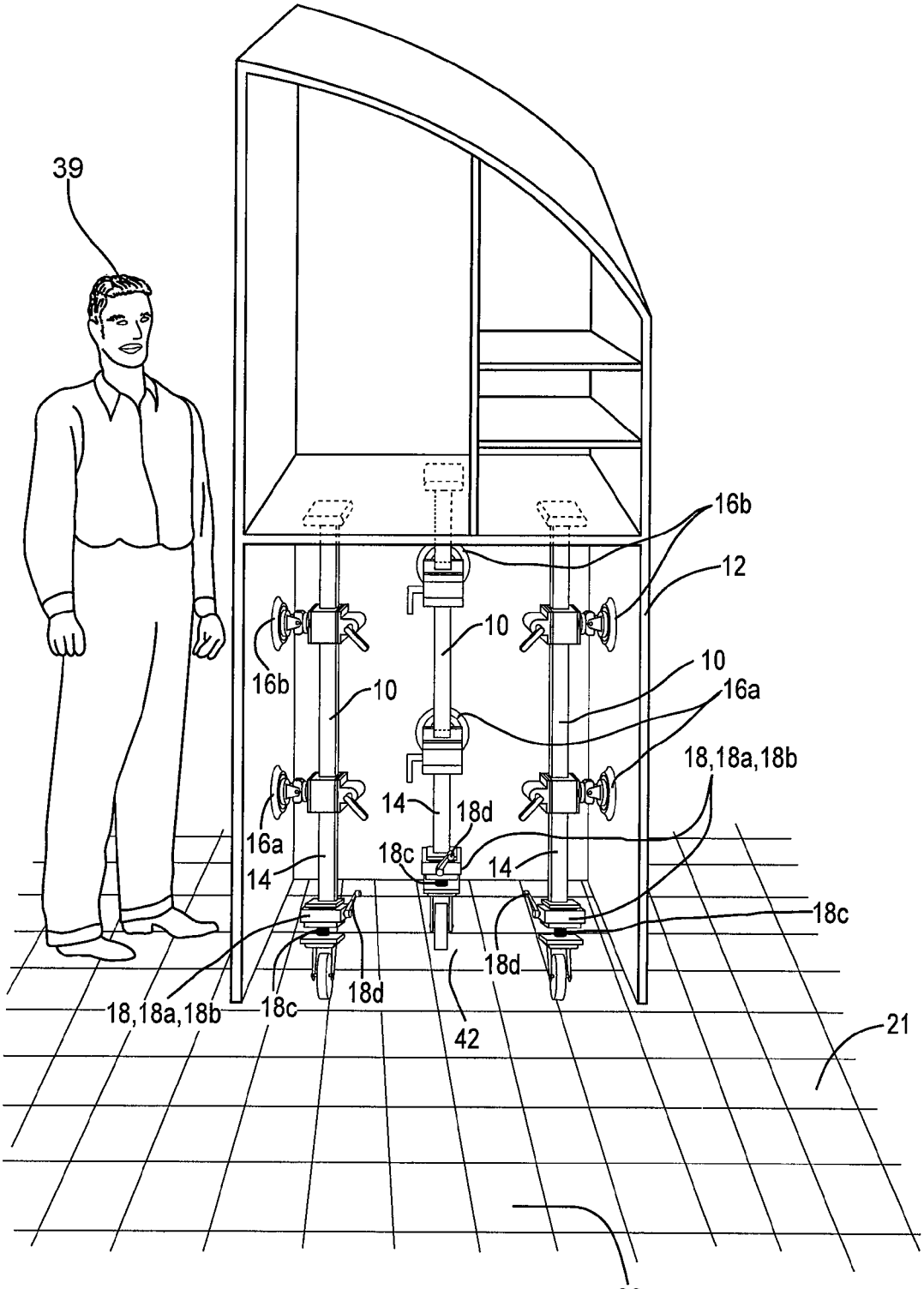
FIG. 5 shows a perspective view of the system and attached object of FIG. 4 having been lowered at the destination location.

In yet another step 43 of the method of FIG. 2, the lifting mechanism 18 of each support unit 10 may be lowered at the destination location 42 to lower the object 12 attached to the at least one suction device 16*a* and/or 16*b* at the destination location 42 as shown in FIG. 5. Step 43 may comprise the user 39 manually rotating the crank 18*d* to lower the elongated member 14 relative to the jack screw 18*c* using the gear drive 18*b*. In such manner, the object 12 may be moved from the departure location 36 along surface 21 to the destination location 42 along surface 21.

Figure 6:
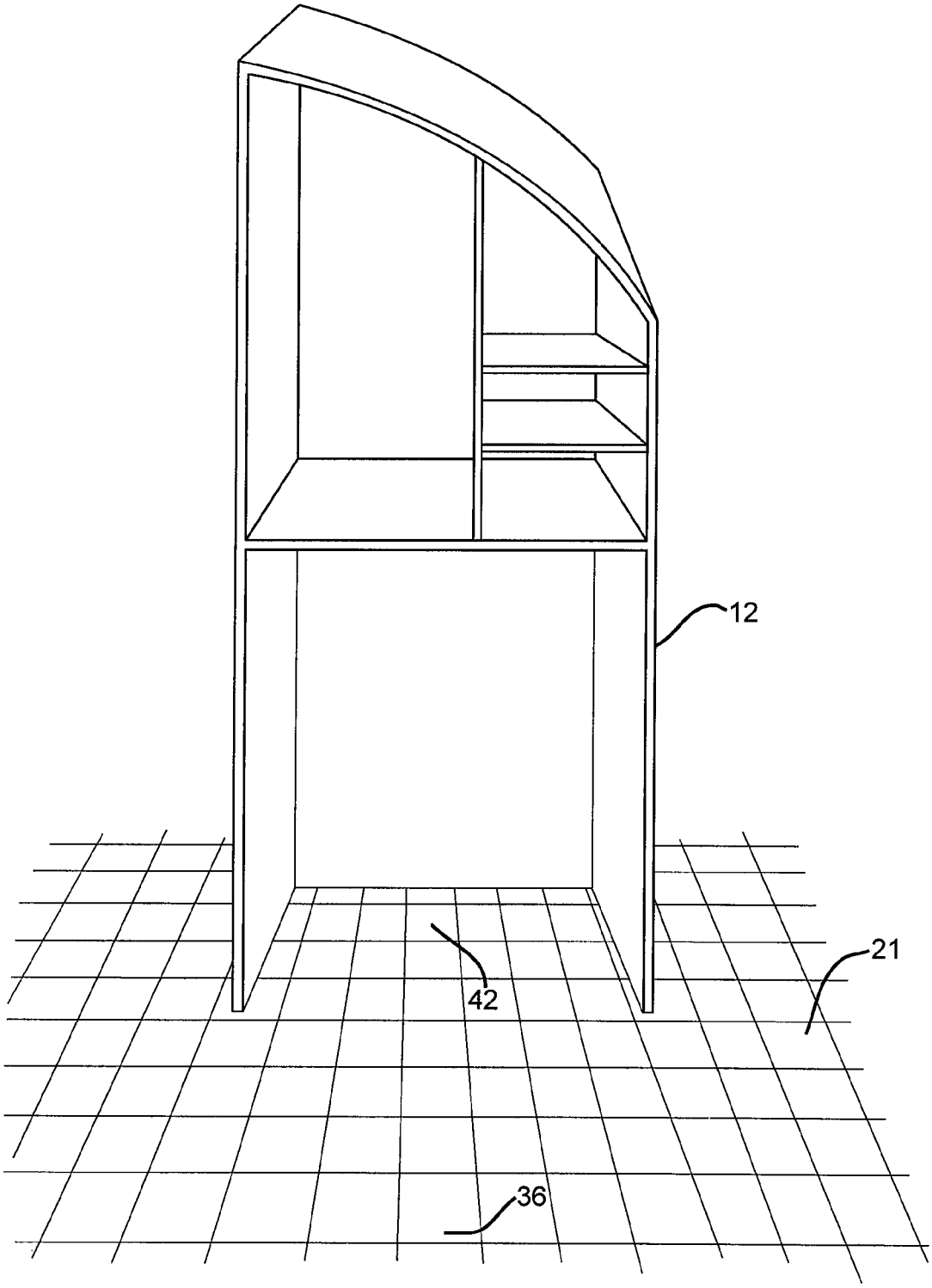
FIG. 6 shows a perspective view of the object of FIG. 5 located at the destination location with the system detached from the object.

In an additional step 44 of the method of FIG. 2, the support units 10 may be removed from the object 12 at the destination location 42 to leave the object 12 disposed at the destination location 42 along surface 21 as shown in FIG. 6.

One or more embodiments of the disclosure may reduce one or more problems of one or more of the prior art systems and/or methods for moving objects by making it easier to move an object, making it less costly to move an object, making it quicker to move an object, making it more efficient to move an object, reducing injury as a result of moving an object, and/or reducing one or more other types of problems.

It should be understood, of course, that the foregoing relates to exemplary embodiments of the disclosure and that modifications may be made without departing from the spirit and scope of the disclosure as set forth in the following claims.

The invention claimed is:

1. A support unit for moving an object comprising:

an elongated member;

at least one attachment device moveably attached to the elongated member for moving along a length of the elongated member, the at least one attachment device for attaching to an object, wherein an end of the elongated member is configured to abut against the object to support the object while the at least one attachment device is attached to the object;

a lifting mechanism attached to the elongated member for raising and lowering the elongated member, the at least one attachment device, and the object attached to the at least one attachment device; and a rotating member for rolling the entire support unit and the object attached to the at least one attachment member from a first location to a second location.

2. The support unit of claim 1 wherein the at least one attachment device comprise at least one suction device.

3. The support unit of claim 2 wherein a plurality of suction devices are attached to one side of the elongated member.

4. The support unit of claim 1 wherein the at least one attachment device is slide-ably connected to the elongated member.

5. The support unit of claim 4 further comprising at least one locking device for locking and unlocking the at least one attachment device to the elongated member.

6. The support unit of claim 1 further comprising at least one swivel device for swiveling the at least one attachment device relative to the elongated member.

7. The support unit of claim 1 further comprising a level device for leveling the object attached to the at least one attachment member.

8. The support unit of claim 2 wherein the at least one suction device is adapted to use vacuum pressure to attach to the object.

9. The support unit of claim 1 wherein the lifting mechanism is attached between the elongated member and the rotating member.

10. The support unit of claim 1 wherein the lifting mechanism comprises a jacking member.

11. The support unit of claim 10 wherein the jacking member comprises a gear drive, a jack screw, or a crank.

12. The support unit of claim 11 wherein the jacking member includes each of the gear drive, the jack screw, and the crank, and the elongated member is adapted to be jacked up and down relative to the jack screw using the gear drive as a result of a user rotating the crank.

13. The support unit of claim 1 wherein the rotating member comprises at least one wheel.

14. The support unit of claim 1 wherein when the support unit is used to move the object, the end of the elongated member is configured to be disposed parallel to a horizontal plane.

15. A method of moving an object comprising:

placing at least one unattached support unit comprising an elongated member, at least one attachment device attached to the elongated member, a lifting mechanism, and a rotating member adjacent to the object;

abutting an end of the elongated member against the object in order to support the object, and attaching the at least one attachment device to the object at a departure location;

raising the lifting mechanism at the departure location to lift the object attached to the at least one attachment device;

moving the lifted object attached to the at least one attachment device, along with the at least one support unit, from the departure location to a destination location by rolling the rotating member; and lowering the lifting mechanism at the destination location to lower the object attached to the at least one attachment device.

16. The method of claim 15 wherein the placing step comprises placing a plurality of unattached support units each comprising an elongated member, at least one attachment device attached to the elongated member, a lifting mechanism, and a rotating member adjacent the object; the abutting step comprises abutting an end of the elongated member of each of the support units against the object in order to support the object, and attaching the at least one attachment device of each of the support units to the object at the departure location; the raising step comprises raising the lifting mechanism of each of the support units at the departure location to lift the object attached to the at least one attachment device of each of the support units; the moving step comprises moving the lifted objected attached to the at least one attachment device of each of the support units, along with the support units, from the departure location to the destination location by rolling the rotating member of each of the support units; and the lowering step comprises lowering the lifting mechanism of each of the support units at the destination location to lower the object attached to the at least one attachment device of each of the support units.

17. The method of claim 16 wherein the attaching step comprises attaching the at least one attachment device of each of the support units to a different surface of the object.

18. The method of claim 16 wherein the abutting step further comprises abutting the end of the elongated member of each of the support units against a different surface of the object than a surface of the object to which its at least one attachment device is attached to at the departure location.

19. The method of claim 16 wherein the plurality of unattached support units comprises three unattached support units.

20. The method of claim 15 wherein the object comprises at least one of an aircraft monument, an airplane galley, or an airplane lavatory.

21. The method of claim 15 wherein the at least one support unit comprises a plurality of attachment devices.

22. The method of claim 15 wherein the attaching step comprises sliding the at least one attachment device along a length of the elongated member, and locking the at least one attachment device in place relative to the elongated member using at least one locking device.

23. The method of claim 15 wherein the attaching step comprises swiveling the at least one attachment device relative to the elongated member using at least one swivel device.

24. The method of claim 15 wherein the attaching step comprises attaching the at least one attachment device to the object using vacuum pressure.

25. The method of claim 15 wherein the lifting mechanism is attached between the elongated member and the rotating member.

26. The method of claim 15 wherein the lifting mechanism comprises a jacking member.

27. The method of claim 26 wherein the jacking member comprises a gear drive, a jack screw, or a crank.

28. The method of claim 27 wherein the jacking member includes each of the gear drive, the jack screw, and the crank, the raising step further comprises a user manually rotating the crank to lift the elongated member relative to the jack screw using the gear drive, and the lowering step further comprises the user manually rotating the crank to lower the elongated member relative to the jack screw using the gear drive.

29. The method of claim 15 wherein the rotating member comprises a single wheel.

30. The method of claim 15 wherein the at least one attachment device comprises at least one suction device.

31. A system for moving an object comprising:

a plurality of support units wherein each support unit comprises:

an elongated member;

at least one attachment device, attached to the elongated member, for attaching to an object;

a rotating member for rolling the entire support unit and the object attached to the at least one attachment device from a first location to a second location; and a lifting mechanism for raising and lowering the elongated member, the at least one attachment device, and the object attached to the at least one attachment device;

wherein the at least one attachment device comprises a suction device, a vacuum device, or when the system is used to move the object, an end of the elongated member of each of the support units is configured to be disposed parallel to a horizontal plane while abutted against the object while the at least one attachment member is attached to the object.

32. The system of claim 31 wherein the at least one attachment device comprises the suction device or the vacuum device.

33. The system of claim 31 wherein when the system is used to move the object, the end of the elongated member of each of the support units is configured to be disposed parallel to the horizontal plane while abutted against the object while the at least one attachment member is attached to the object.

34. The system of claim 31 wherein the plurality of support units comprises at least three support units.

35. A method of moving an object comprising:

placing a plurality of unattached support units, each comprising an elongated member, at least one attachment device attached to the elongated member, a lifting mechanism, and a rotating member, adjacent the object;

attaching the at least one attachment device of each support unit to the object at a departure location using at least one of suction or vacuum pressure;

raising the lifting mechanism of each support unit at the departure location to lift the object attached to the at least one attachment device of each support unit;

moving the lifted object attached to the at least one attachment device of each support unit, along with the plurality of support units, from the departure location to a destination location by rolling the rotating member of each support unit; and lowering the lifting mechanism of each support unit at the destination location to lower the object attached to the at least one attachment device of each support unit.

* * * * *